United States Patent [19]

Meadows

[11] 4,420,148

[45] Dec. 13, 1983

[54] METHOD AND APPARATUS FOR FOLDING A COVER STRIP OVER A MULTI-PLY INNER STRIP

[75] Inventor: Clayton D. Meadows, Itasca, Ill.

[73] Assignee: The Wessel Company, Inc., Elk Grove Village, Ill.

[21] Appl. No.: 360,449

[22] Filed: Mar. 22, 1982

[51] Int. Cl.[3] ..... B41L 43/04

[52] U.S. Cl. ..... 270/41; 493/439

[58] Field of Search ..... 270/39–41, 270/37; 493/438–440

[56] References Cited

U.S. PATENT DOCUMENTS

| | | | |
|---|---|---|---|
| 2,540,844 | 2/1951 | Strauss | 493/439 |
| 3,993,299 | 11/1976 | O'Brien | 270/37 X |
| 4,066,251 | 1/1978 | Johnsen | 270/37 |
| 4,340,212 | 7/1982 | Simson | 493/439 X |

*Primary Examiner*—A. J. Heinz

*Attorney, Agent, or Firm*—Merriam, Marshall & Bicknell

[57] ABSTRACT

A composite strip is formed, during a folding step, from a continuous cover strip folded around a continuous, multi-ply inner strip. The cover strip has longitudinally spaced transverse slits therein and is tensioned during the folding step. A sharp, neat fold is obtained without transversely tearing the cover strip.

9 Claims, 6 Drawing Figures

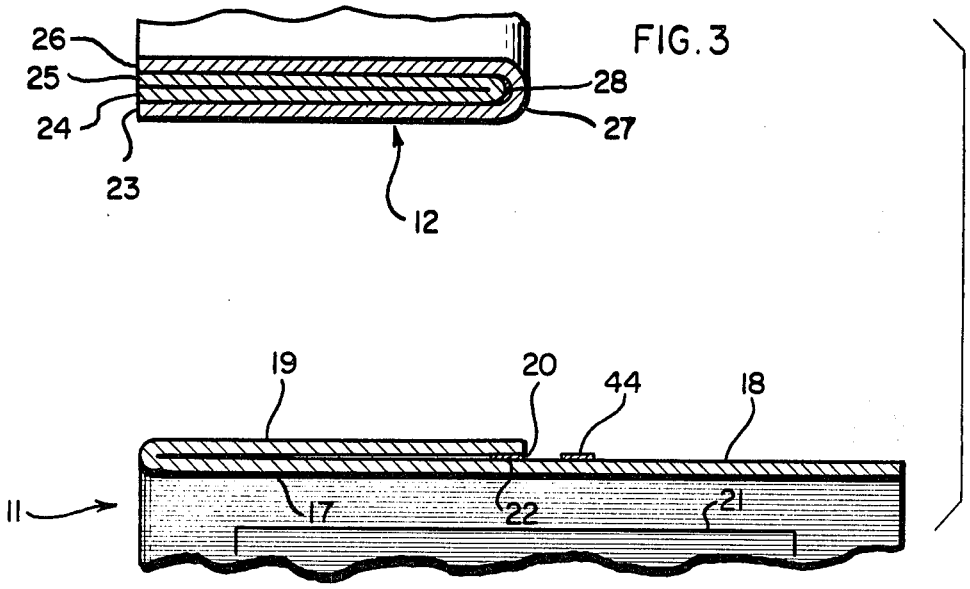
FIG. 3
FIG. 4
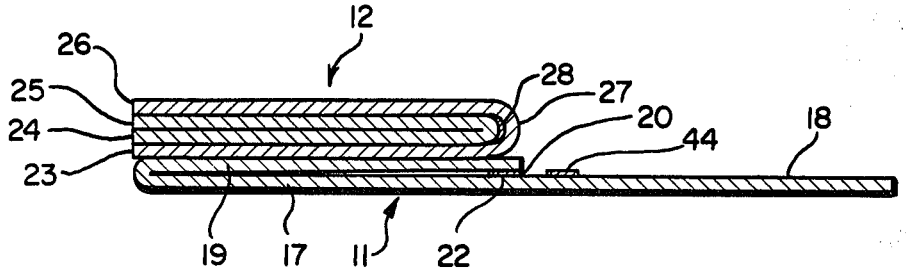
FIG. 5
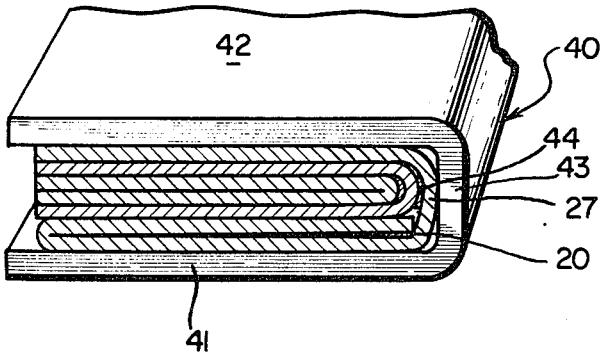
FIG. 6
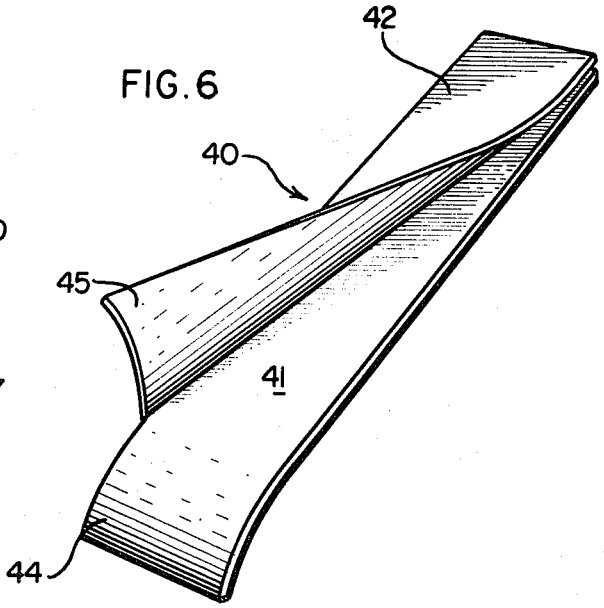

METHOD AND APPARATUS FOR FOLDING A COVER STRIP OVER A MULTI-PLY INNER STRIP

BACKGROUND OF THE INVENTION

The present invention relates generally to booklet manufacturing methods and apparatuses and more particularly to methods and apparatuses for manufacturing booklets from a multiplicity of continuous strips of paper having printed matter thereon.

Booklets of the type relevant here comprise a plurality of inner pages and front and back cover parts. In a conventional booklet manufacturing process, the inner pages of the booklet are formed by adhering together a plurality of continuous paper strips along a longitudinal center line of each and then folding them over, employing conventional adhering and folding operations to provide a continuous paper strip having a folded longitudinal edge or spine and a multiplicity of plies each of which corresponds to a page in the booklets. The multi-ply continuous strip constituting the inner pages of the booklets (hereinafter called the inner strip) is then inserted within and adhered to another continuous paper strip from which are formed the covers for the booklets. This last-described operation is usually accomplished by applying a longitudinal strip of adhesive along the cover strip, with the latter in an unfolded condition, laying the folded, multi-ply inner strip atop the cover strip, with the spine of the inner strip located along or adjacent the strip of adhesive on the cover strip, pressing the two strips together to adhere them, and folding one part of the unfolded strip over the inner strip to form a cover for the booklets.

When the cover strip is folded over, in the manner described in the preceding paragraph, there is formed on the cover strip a longitudinal fold edge adjacent the spine on the inner strip pages. It is desirable that the longitudinal fold edge on the cover be a sharp, neat fold, for aesthetic or appearance purposes. A sharp, neat fold is usually effected by tensioning the strips while they undergo folding. If the fold is not sharp enough or neat enough, this can usually be corrected in conventional methods by increasing the tension on the strips while they undergo folding.

After the cover strip has been folded around the inner strip, booklets are formed from the resulting composite strip by making transverse cuts at regularly spaced locations along the composite strip.

It is sometimes desirable to provide the front cover part of the booklet with a transverse slit. An example of such a booklet is one in which the cover is a ticket holder for holding air line tickets, for example. The front cover part of the ticket holder has a pocket on the inside thereof, and there is a transverse slit on the outside of the front cover part which communicates with the pocket.

In the booklet manufacturing operation, the front and back cover parts of the ticket holders are formed from a continuous cover strip having first and second parts extending in adjacent relationship along a longitudinal folding line, with transverse slits cut at longitudinally spaced intervals on the first part of the strip. Each transverse slit corresponds to one ticket holder.

In lapped, folded relation with the first part of the continuous cover strip is an additional longitudinally extending part having a terminal edge adhered to the first part adjacent the longitudinal folding line. The first part eventually becomes the front cover part, and the additional part eventually becomes the inside wall of a pocket having an outside wall formed by the front cover part.

As previously noted, the booklet pages are formed from a continuous inner strip of paper having multiple plies, and this inner strip has a transverse dimension corresponding substantially to the transverse dimension of the first part on the cover strip. The inner strip is laid atop the first part of the cover strip, and the first part of the cover strip becomes a bottom cover part under the inner strip during the manufacturing operation. At the time the cover strip is folded over the inner strip, both strips are in tension. The second part of the cover strip is folded along the longitudinal folding line, out of the plane of the cover strip, and then over and atop the multi-ply inner strip to provide a top cover part over the inner strip and a longitudinal edge at the folding line.

When the second part of the cover strip is folded out of the plane of the cover strip, there is a substantial decrease in the amount of tension which is being absorbed by the second part. As a result, there is a significant increase in the amount of tension required to be absorbed by the first part of the cover strip. Because the first part of the cover strip has transverse slits therein, it does not have the strength to withstand the tension it would otherwise withstand without the transverse slits, and there is a danger of tearing transversely from the transverse slit to the longitudinal folding line on the cover strip, during the folding operation when the first part is absorbing increased tension.

To avoid such transverse tearing requires a reduction in the tension in the cover strip, and when the tension in the cover strip is reduced to avoid transverse tearing, the fold obtained along the longitudinal folding line will generally not be a sharp, neat fold.

SUMMARY OF THE INVENTION

In accordance with the present invention, a method and apparatus are provided which minimizes the danger of transverse tearing while providing the desired sharp, neat fold. This is accomplished by tensioning the cover strip enough to avoid slack in that strip at the time of the folding step, while at the same time controlling the tension in the cover strip below that tension which would cause transverse tearing. In addition, the first part of the cover strip is supported from below during the folding step, and structure is provided for urging the folded, longitudinal edge of the cover strip, resulting from the folding operation, in a transverse direction toward the inner strip during the folding operation.

All of the aforementioned operations result in a sharp, neat fold along the longitudinal folding line.

Other features and advantages are inherent in the method and apparatus claimed and disclosed or will become apparent to those skilled in the art from the following detailed description in conjunction with the accompanying diagrammatic drawings.

BRIEF DESCRIPTION OF THE DRAWINGS

FIG. 3 is a sectional view taken along line 3—3 in FIG. 1;

FIG. 4 is a sectional view taken along line 4—4 in FIG. 2;

FIG. 5 is a sectional view taken along line 5—5 in FIG. 2; and

FIG. 6 is a perspective of part of the folding apparatus utilized in the present invention.

DETAILED DESCRIPTION

Figure 1:
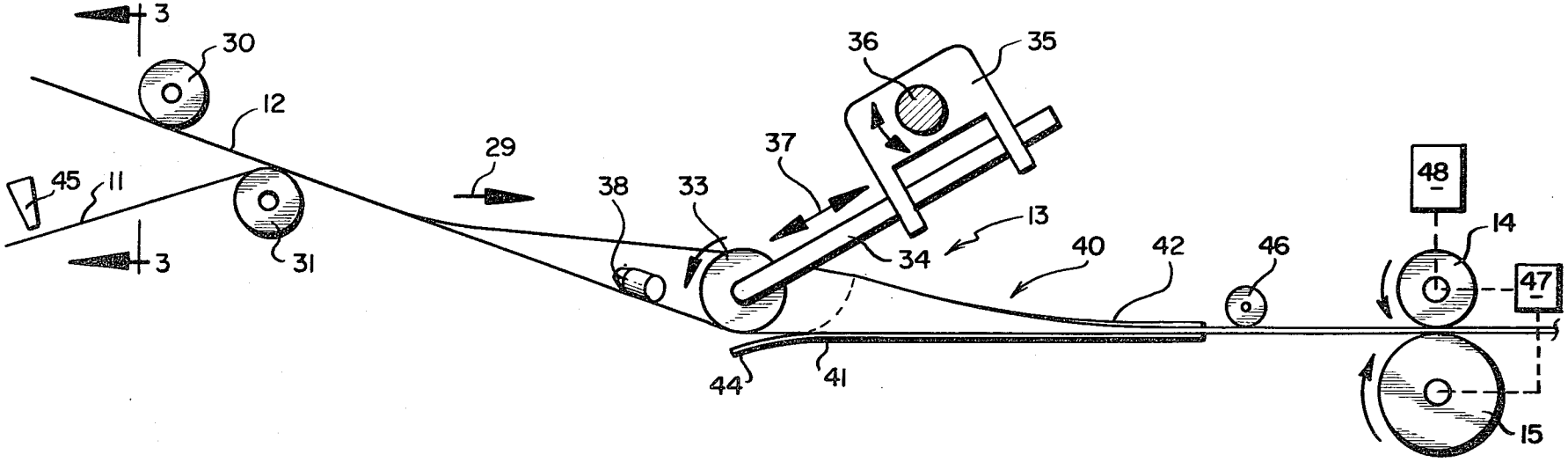
FIG. 1 is a side view illustrating an embodiment of a method and apparatus in accordance with the present invention.
Figure 2:
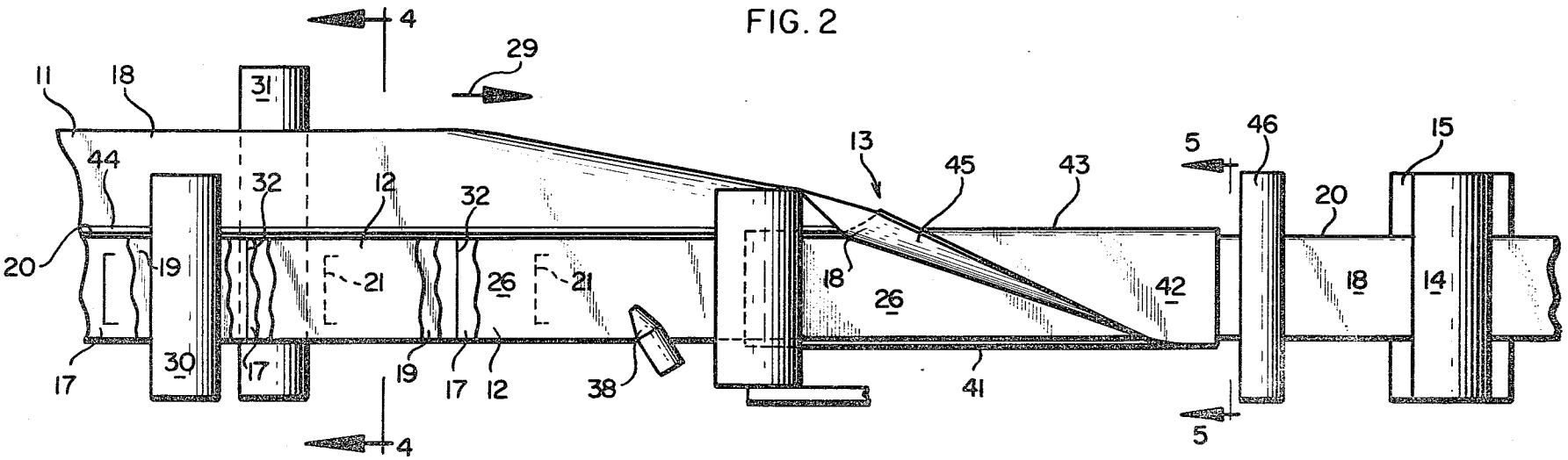
FIG. 2 is a plan view of the method and apparatus illustrated in FIG. 1.

Referring initially to FIGS. 1 and 2, 11 is a continuous strip of printed paper constituting a cover strip which is advanced longitudinally in a downstream direction along a predetermined path having a downstream portion illustrated in FIGS. 1 and 2. Indicated at 12 is a continuous inner strip which is advanced longitudinally in a downstream direction along a predetermined path having a downstream portion corresponding to the downstream portion on the path of cover strip 11. Inner strip 12 is laid atop a part of cover strip 11 at a location upstream of a folding station indicated generally at 13, and another part of cover strip 11 is folded over atop inner strip 12 at folding station 13. Between the laying step and the folding step, strips 11, 12 undergo no further processing.

A pair of driving rollers 14, 15, located downstream of folding station 13, advance strips 11, 12 along their paths and tension the strips, at least at folding station 13 and downstream thereof.

Referring to FIGS. 2–4, cover strip 11 constitutes a continuous strip of paper having first and second parts 17, 18, extending in adjacent relationship along a longitudinal folding line 20, with transverse slits 21, 21 located at longitudinally spaced intervals on first part 17. Cover strip 11 also includes an additional longitudinally extending part 19 in lapped, folded relation with first part 17 and terminating at an edge which extends along longitudinal folding line 20. Additional part 19 is adhered to first part 17, adjacent longitudinal folding line 20, by a longitudinally extending strip of adhesive 22 (FIG. 3) and by transversely extending strips of adhesive 32 (FIG. 2). There is a transverse adhesive strip 32 for each booklet cover/ticket holder to be formed from cover strip 11, and each pocket on the ticket holder has two of its edges defined by longitudinally and transversely extending adhesive strips 22 and 32 respectively.

Referring to FIGS. 3–4, inner strip 12 comprises a multiplicity of plies 23–26 longitudinally folded in nesting relation along a line. Plies 24 and 25 are formed from a single strip which is folded in half, and plies 23, 26 also are formed from a single strip which is folded in half around the outside of previously folded plies 24, 25. The folding and arrangement of plies 23–26 and the equipment for doing so is all in accordance with conventional methods and apparatuses and is performed upsteam of the path portion illustrated in FIGS. 1–2. Inner strip 12 has a spine 27 defined by the fold line for the plies of strip 12, and folded plies 24, 25 are adhered to folded plies 23, 26 along the inside of spine 27 at a longitudinally extending strip of adhesive 28. Plies 24, 25 are adhered to plies 23, 26 along adhesive strip 28 by employing conventional methods and apparatuses located upstream of the path portion illustrated in FIGS. 1–2.

As previously indicated, strips 11, 12 are advanced by driving rollers 14, 15 in a downstream direction, indicated by arrow 29 in FIGS. 1–2. Initially, inner strip 12 is located above cover strip 11. At the upstream part of the path portion illustrated in FIGS. 1–2, inner strip 12 passes under a roller 30, and cover strip 11 passes over a roller 31. Rollers 30 and 31 are both located upstream of folding station 13. At roller 31, inner strip 12 is laid atop additional part 19 of cover strip 11 which in turn overlies first part 17 of cover strip 11. As a result, first part 17 of cover strip 11 becomes a bottom cover part under inner strip 12. Inner strip 12 has a transverse dimension corresponding substantially to that of cover strip parts 17 and 19, so that none of inner strip 12 extends in a transverse direction past longitudinal folding line 20 (see FIGS. 2 and 4).

Referring now to FIGS. 1 and 2, folding station 13 comprises a roller 33 rotatable about its axis and attached to one end of an arm 34 adjustably mounted on a bracket 35. Arm 34 is adjustable back and forth along the length thereof in the directions indicated by double arrow 37. Bracket 35 is mounted for pivotal adjustment about the axis of a roller 36. Located upstream of roller 33, adjacent thereto, is an element 38 with a conical tip and which functions as a guiding device during the folding operation. All of the plies of inner strip 12 and lapped parts 17, 19 of cover strip 11 pass under the conical tip of element 38 as strips 11, 12 advance toward folding station 13.

With reference to FIGS. 1, 2, 5, and 6, also constituting part of folding station 13 is a device 40 having lower and upper members 41, 42. Lower member 41 underlies strips 11, 12, while they undergo folding, and upper member 42 overlies strips 11, 12 during the folding operation and assists in the folding of the cover strip's second part 18 over and atop multi-ply inner strip 12.

By virtue of the operation of drive rollers 14, 15 (to be described subsequently in greater detail) in cooperation with the structural elements located upstream thereof, cover strip 11 and inner strip 12 are both subjected to tensioning at folding station 13 and downstream thereof. Before the commencement of the folding step, all of the parts 17–19 of cover strip 11, lie essentially in the plane of cover strip 11, and each absorbs some of the tension in the strip. During the folding step, second part 18 of the tensioned cover strip is folded out of the plane of strip 11, and when this occurs, there is a decrease in the tension absorbed by second part 18 and an increase in the tension which first part 17 is required to absorb.

Because first part 17 has transverse slits 21, 21 therein, there is a danger of transverse tearing on first part 17 from a transverse slit 21 to longitudinal folding line 20 if the tension which first part 17 is required to absorb is too great. Accordingly, drive rolls 14, 15 are controlled, in a manner to be subsequently described, so that the tension in the plane of cover strip 11 is sufficient to avoid slack in that strip, but is also sufficiently small to avoid the transverse tearing described above.

However, when the tension in cover strip 11 is controlled in the manner described in the preceding paragraph, there is a problem in that the sharp, neat fold desired at longitudinal folding line 20 is difficult to obtain. This problem is overcome by employing device 40, in cooperation with certain manipulative steps and other structure in accordance with the present invention. More specifically, lower member 41 on device 40 supports first part 17 of cover strip 11 from below during the folding step. Lower member 41 is joined to upper member 42 by an edge portion 43, and, during the folding operation, edge portion 43 engages longitudinal fold line 20, on cover strip 11, and urges the longitudinal booklet edge formed along line 20 in a transverse direction toward inner strip 12, during the folding step (FIG.

5). (In FIG. 5, the thickness of plies 23–26 and strip parts 17–19 and the vertical dimension of edge portion 43 on device 40 are exaggerated for purposes of illustration and clarity.)

Lower member 41 on device 40 has an upstream portion 44 which is flared downwardly to facilitate reception and support of the cover strip's first part 17. Upper member 42 has an upwardly and outwardly flaring upstream portion 45 which, with the rest of upper member 42, acts to urge second part 18 of cover strip 11 downwardly toward inner strip 12 as the strips move downstream during the folding step.

Multi-ply inner strip 12 is adhered within cover strip 11 in the following manner. Located upstream of roller 31 on the path of cover strip 11 is an applicator 45 for applying a longitudinally extending line of adhesive 44 on cover strip 11 adjacent longitudinal folding line 20. In the illustrated embodiment, adhesive line 44 is shown as being applied on second part 18 of cover strip 11. However, this adhesive line may, optionally, be applied on part 19 of cover strip 11. In either case, adhesive line 44 is always applied adjacent longitudinal folding line 20. After adhesive line 44 has been applied to cover strip 11, inner strip 12 is laid atop cover strip 11 in such a manner that the inner strip is adhered to the cover strip at the spine 27 of inner strip 12 on the outside surface of the spine.

The outside surface of spine 27 may be pressed against adhesive line 44 at a number of locations, depending upon whether adhesive line 44 is on second part 18 or third part 19 of cover strip 11. For example, when adhesive line 44 is on second part 18, spine 27 is pressed against adhesive line 44 at the downstream end of folding device 40, by edge portion 43 on folding device 40, by a roller 46 located immediately downstream of folding device 40, and by driving rollers 14, 15.

The speed of rollers 14, 15 is controlled by a conventional speed control device illustrated diagrammatically at 47 and mechanically connected to rollers 14, 15. Also associated with roller 15 is a device 46, mechanically connected to roller 14, for controlling the load on roller 14, that is, the force with which roller 14 presses downwardly against roller 15. Speed control device 47 and load control device 46 are of conventional construction.

As previously indicated, the tension in cover strip 11 is controlled so that it is at a minimum without there being a slack in the strip at the folding station. This is accomplished by adjusting the speed of rollers 14, 15. Adjusting the loading on upper roller 14 adjusts the speed with which the strips advance along their respective paths. As a result of the controls exercized at 46, 47, both strips 11 and 12 are tensioned in the planes thereof at folding station 13 and downstream thereof.

Folding device 40 has two functions in addition to cooperating in the folding of second part 18 of cover strip 11 over and atop inner strip 12 and parts 17 and 19 of the cover strip. One such function is to provide support for the transversely slitted first part 17 of the cover strip, thereby enabling a slight increase in the amount of tension to which the cover strip may be subjected without a transverse tearing in first part 17. A further function of folding device 40 is to urge the cover strip's second part 18 downwardly toward inner strip 12 during the folding step and to urge the longitudinal edge at folding line 20 transversely inwardly against inner strip 12. Both of these functions cooperate, with other manipulative steps in the method, to provide a tight, neat fold when cover strip 11 is folded about inner strip 12.

Downstream of driving rollers 14, 15 the composite booklet strip comprising cover strip 11 folded about inner strip 12 is formed into a multiplicity of individual booklets by making transverse cuts across the composite strip at predetermined longitudinally spaced intervals employing conventional apparatus and procedures (not shown).

The foregoing detailed description has been given for clearness of understanding only, and no unnecessary limitation should be understood therefrom as modifications will be obvious to those skilled in the art.

I claim:

1. In a booklet manufacturing process, a method for folding a cover strip having a transverse slit over a multi-ply inner strip, said method comprising the steps of:

providing one continuous strip of paper having first and second parts extending in adjacent relationship along a longitudinal folding line, with transverse slits at longitudinally spaced intervals on said first part;

said first part having a transverse dimension;

advancing said one continuous strip longituninally in a downstream direction along a predetermined path having a downstream portion;

providing another continuous strip of paper having multiple plies longitudinally folded in nested relation along a line to define a spine for said other strip along the fold line for said plies, said other continuous strip having a transverse dimension corresponding substantially to the transverese dimension of said first part on said one strip;

advancing said other continuous strip longitudinally in a downstream direction along a predetermined path and above said first part on said one strip, said predetermined path of the inner strip having a downstream portion corresponding to the downstream portion of the path of said cover strip;

providing a folding station at a predetermined location on said downstream path portion;

laying said other strip atop the first part of said one strip upstream of said folding station, whereby the first part of the one strip becomes a bottom cover under the second strip;

said one strip lying in a plane as said strip advances toward said folding station;

tensioning said one strip in the plane thereof, at said folding station, to avoid slack in said strip;

folding said second part of the tensioned one strip along said longitudinal folding line, out of the plane of the one strip and then over and atop said multiply second strip to provide a top cover over the second strip and a longitudinal edge at said folding line;

controlling the tension in said one strip during said folding step to avoid transverse tearing on said first part thereof from said transverse slit to said longitudinal folding line;

supporting said first part of the one strip from below during said folding step;

urging said second part of the one strip downwardly toward said other strip as the strips move downstream during said folding step;

urging said longitudinal edge in a transverse direction toward said other strip during said folding step;

applying a longitudinally extending line of adhesive on said one strip adjacent said longitudinal folding line, prior to said laying step;

and adhering said spine to said one strip at said line of adhesive, after said applying step.

2. A method as recited in claim 1 and comprising:

providing said one continuous strip with an additional longitudinally extending part in lapped, folded relation with said first part.

3. A method as recited in claim 1 wherein:

said other strip lies in a plane at said folding station and downstream thereof;

and said tensioning step comprises tensioning said other strip in its plane at said folding station and tensioning both of said strips downstream of said folding station.

4. A method as recited in claim 1 wherein said tension controlling step comprises:

controlling said tension so that it is at a minimum without there being slack in said one strip at said folding step.

5. A method as recited in claim 1 wherein:

said supporting step enables an increase in the amount of said tension to which said one strip may be subjected without said transverse tearing.

6. A method as recited in claim 1 wherein:

said strips undergo no further processing between said laying step and said folding step.

7. An apparatus for folding a booklet cover strip having a transverse slit over a multi-ply inner strip, wherein said cover strip comprises a continuous strip of paper having first and second parts extending in adjacent relationship along a longitudinal folding line, with transverse slits at longitudinally spaced intervals on said first part, said first part having a transverse dimension, and said inner strip comprises a continuous strip of paper having multiple plies longitudinally folded in nested relation along a line to define a spine for said inner strip along the fold line for said plies, said inner continuous strip having a transverse dimension corresponding substantially to the transverse dimension of said first part on said cover strip, said apparatus comprising:

means for advancing said continuous cover strip longitudinally in a downstream direction along a predetermined path having a downstream portion;

means for advancing said continuous inner strip longitudinally in a downstream direction along a predetermined path and above said first part on said cover strip, said predetermined path of the inner strip having a downstream portion corresponding to the downstream portion on the path of said cover strip;

means defining a folding station at a predetermined location on said downstream path portion;

means for laying said inner strip atop the first part of said cover strip upstream of said folding station and for arranging the first part of the cover strip as a bottom cover under the inner strip;

said advancing means for the cover strip comprising means for advancing said cover strip toward said folding station with the cover strip lying in a plane;

means for tensioning said cover strip in the plane thereof, at said folding station, to avoid slack in said cover strip;

means at said folding station for folding said second part of the tensioned cover strip along said longitudinal folding line, out of the plane of the cover strip and then over and atop said multi-ply inner strip to provide a top cover over the inner strip and a longitudinal edge at said folding line;

means for controlling the tension of said cover strip at said folding station to avoid transverse tearing on said first part thereof from said transverse slit to said longitudinal folding line;

means for supporting said first part of the cover strip from below at said folding station;

means for urging said second part of the cover strip downwardly toward said inner strip as the strips move downstream at said folding station;

means for urging said longitudinal edge in a transverse direction toward said inner strip at said folding station;

means for applying a longitudinally extending line of adhesive on said cover strip adjacent said longitudinal folding line, upstream of said laying means;

and means for adhering said spine to said cover strip at said line of adhesive, downstream of said applying means.

8. An apparatus as recited in claim 7 wherein said continuous cover strip has an additional longitudinally extending part in lapped, folded relation with said first part.

9. An apparatus as recited in claim 7 wherein:

said advancing means for the inner strip comprises means for advancing said inner strip in a plane at said folding station and downstream thereof;

and said tensioning means comprises means for tensioning said other strip in its plane at said folding station and means for tensioning both of said strips downstream of said folding station.

* * * * *